US005197272A

United States Patent [19]

Frey

[11] Patent Number: 5,197,272

[45] Date of Patent: Mar. 30, 1993

[54] APPARATUS FOR THE AUTOMATIC REMOVAL OF BOBBINS FROM A BANK OF SPINDLES FOR LONG FIBERS AND SHORT FIBERS AND PROCESS FOR USING THIS APPARATUS

[75] Inventor: Michel Frey, Mulhouse, France

[73] Assignee: N. Schlumberger et Cie, S.A., Guebwiller, France

[21] Appl. No.: 738,739

[22] Filed: Jul. 30, 1991

[30] Foreign Application Priority Data

Jul. 30, 1990 [FR] France ..... 90 09875

[51] Int. Cl.[5] ..... D01H 9/00; D01H 9/10

[52] U.S. Cl. ..... 57/267; 57/270; 57/273; 57/281

[58] Field of Search ..... 57/281, 267–268, 57/270, 273, 90

[56] References Cited

U.S. PATENT DOCUMENTS

| | | | |
|---|---|---|---|
| 3,788,054 | 1/1974 | Haussmann et al. | 57/281 |
| 3,924,762 | 12/1975 | Igel | 57/281 X |
| 3,935,699 | 2/1976 | Iida et al. | 57/267 |
| 4,051,652 | 10/1977 | Hirano et al. | 57/270 |
| 4,137,701 | 2/1979 | Herubel | 57/267 |
| 4,369,621 | 1/1983 | Kogiso | 57/267 |
| 4,630,435 | 12/1986 | Igel | 57/90 X |
| 4,805,352 | 2/1989 | Grassle et al. | 57/281 X |
| 5,022,223 | 6/1991 | Mena | 57/281 X |

FOREIGN PATENT DOCUMENTS

| | | | |
|---|---|---|---|
| 0214837 | 3/1987 | European Pat. Off. | 57/273 |
| 0310568 | 4/1989 | European Pat. Off. . | |
| 1-85330 | 3/1989 | Japan | 57/268 |

*Primary Examiner*—Daniel P. Stodola
*Assistant Examiner*—William Stryjewski
*Attorney, Agent, or Firm*—Young & Thompson

[57] ABSTRACT

Process and apparatus for the automatic removal of bobbins from a bank of spindles. A transporting fork has a plurality of recesses for simultaneously handling a plurality of spindles. The transporting fork is movable in a vertical direction and in at least one horizontal direction parallel to a bank of spindles on a spindle carrying carriage. A cup is insertable over each spindle for the support and manipulation of bobbins. A conveyor evacuates full bobbins and supplies empty bobbins. The fork releasably retains a cup in each recess whereby each cup can be penetrated by and disengaged from the fork upon movement of the fork in a horizontal direction.

6 Claims, 4 Drawing Sheets

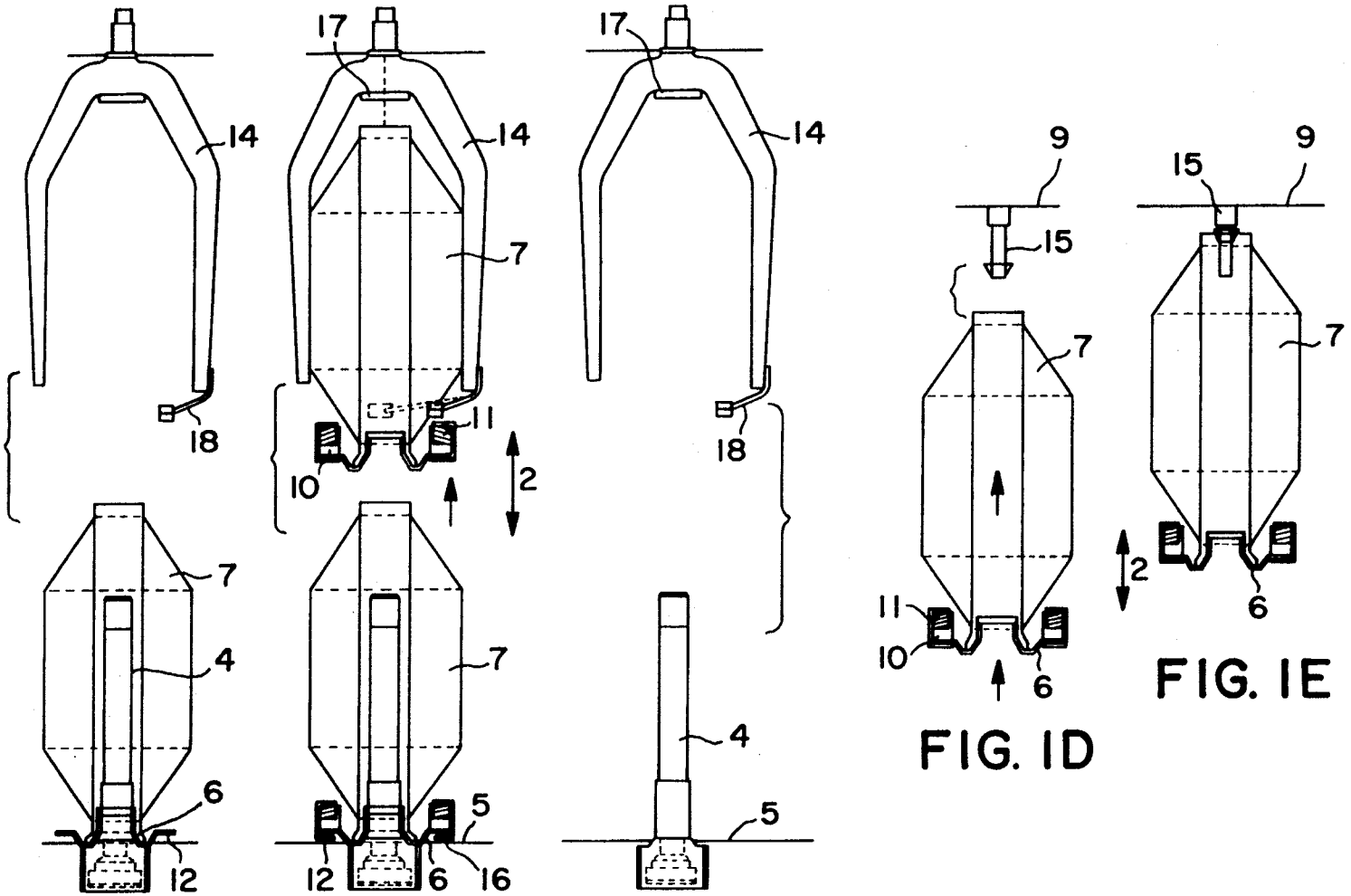
9
7
15
6
2
FIG. IE
9
15
7
6
11
10
FIG. ID
14
18
17
4
5
FIG. IC
14
7
11
2
17
10
7
5
16
6
12
FIG. IB
14
18
7
4
6
12
FIG. IA

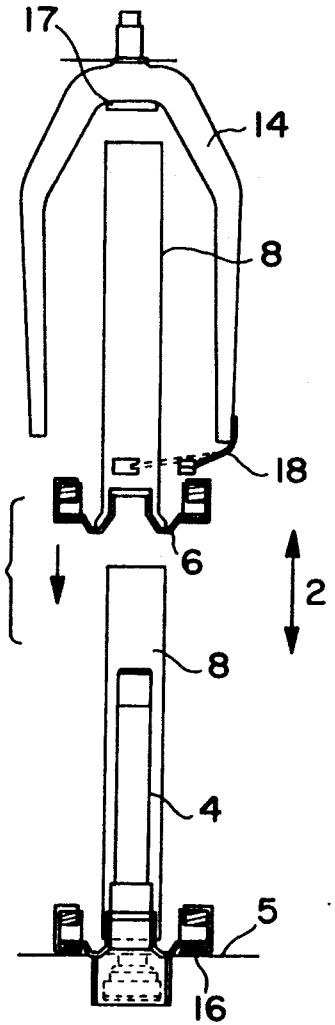
FIG. IJ
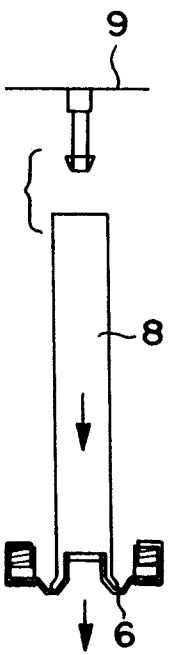
FIG. II
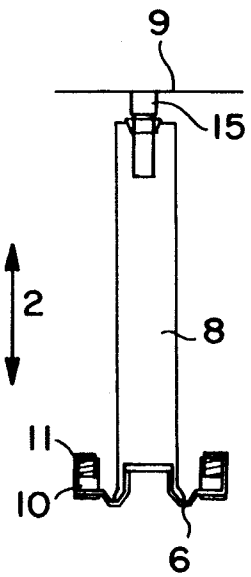
FIG. IH
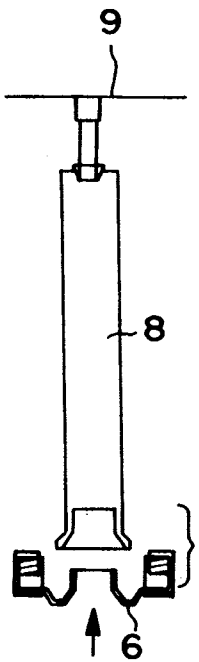
FIG. IG
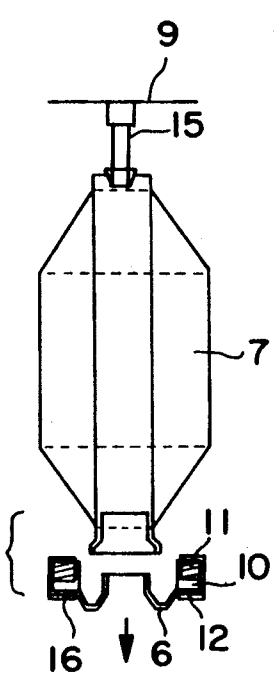
FIG. IF

APPARATUS FOR THE AUTOMATIC REMOVAL OF BOBBINS FROM A BANK OF SPINDLES FOR LONG FIBERS AND SHORT FIBERS AND PROCESS FOR USING THIS APPARATUS

FIELD OF THE INVENTION

The present invention relates to the textile industry, more particularly to banks of spindles for long fibers and short fibers, and has for its object apparatus for the automatic removal of bobbins from a bank of spindles for long fibers and short fibers as well as a process for using this apparatus.

BACKGROUND OF THE INVENTION

At present, the removal of full bobbins from the spindles of a bank of spindles and their replacement by empty bobbins are still, in most cases, operations performed manually and requiring substantial work on the part of the operators who perform this work.

There also exist various semi-automatic and automatic apparatus permitting the performance of these operations. Generally speaking, these involve in the first instance the inclination of the spindle bearing carriage, then the extraction and removal of the full bobbins by means of mechanical devices provided with grippers or manipulating arms, assembling the full bobbins in a region spaced from the empty bobbins and, finally, replacing empty bobbins on the spindles.

Nevertheless, these known devices often have, on the one hand, insufficient precision as to their operation, arising from numerous misfunctions of the corresponding banks of spindles and involving, on the other hand, the non-use of that portion of the empty bobbins necessary for gripping the full bobbins, from which arises a loss of usable length of said empty bobbins.

The present invention has for its particular object to overcome the above drawbacks.

SUMMARY OF THE INVENTION

The invention thus provides an apparatus for the automatic removal of bobbins from a bank of spindles for long fibers and short fibers, characterized in that it is principally constituted, on the one hand, by a carrier fork, movable in a vertical direction and in at least one horizontal direction parallel to the transverse alignment of the spindles of the spindle-carrying carriage, on the other hand by support and manipulation cups for the full bobbins and the empty bobbins, and, finally, by a conveyor for the evacuation of the full bobbins and the feeding of the empty bobbins.

The invention also provides a process for automatic removal of bobbins from a bank of spindles for long fibers and short fibers, using the above apparatus, which process is characterized in that it consists, at the end of winding up on the bobbins, breaking the yarn and disengagement of the full bobbins from their corresponding flyers, lowering the spindle carrier as the case may be, removing said full bobbins from their corresponding spindles and transporting them toward an overhead conveyor, by means of a carrier fork coacting with cups threaded on said spindles and each supporting a bobbin, hanging said bobbins on empty bobbin carriers of said conveyor, the cups remaining unitary with the fork, then detaching an equal number of the empty bobbins from the conveyor by means of said cups, transporting them toward the free spindles of the spindle carrier, threading them together with the cups which support them on said spindles and, finally, disengaging said transporting fork from said threaded cups and bringing it to a disengaged rest position.

BRIEF DESCRIPTION OF THE DRAWINGS

The invention will be better understood from the following description, which relates to a preferred embodiments, given by way of non-limiting examples, and explained with reference to the accompanying schematic drawings, in which:

FIG. 1 (1A, 1B, 1C, 1D, 1E, 1F, 1G, 1H, 1I and 1J) show, in front elevational views with respect to a single bobbin, the principal stages of the process according to the invention;

DETAILED DESCRIPTION OF THE INVENTION

Figure 2:
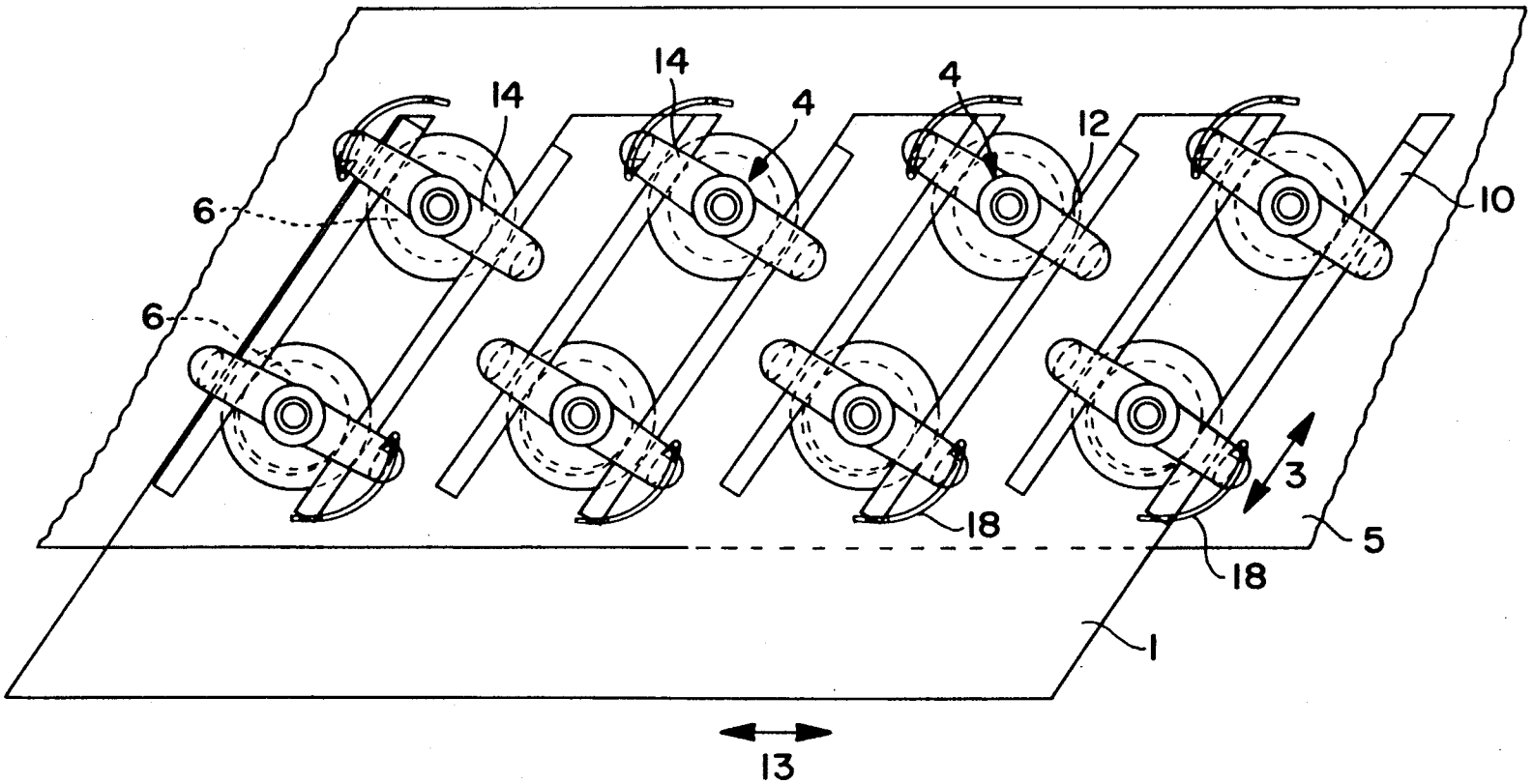
FIG. 2 is a plan view of the structure of the apparatus according to the invention, shown in the phase of the process corresponding to FIG. 1J.
Figure 3:
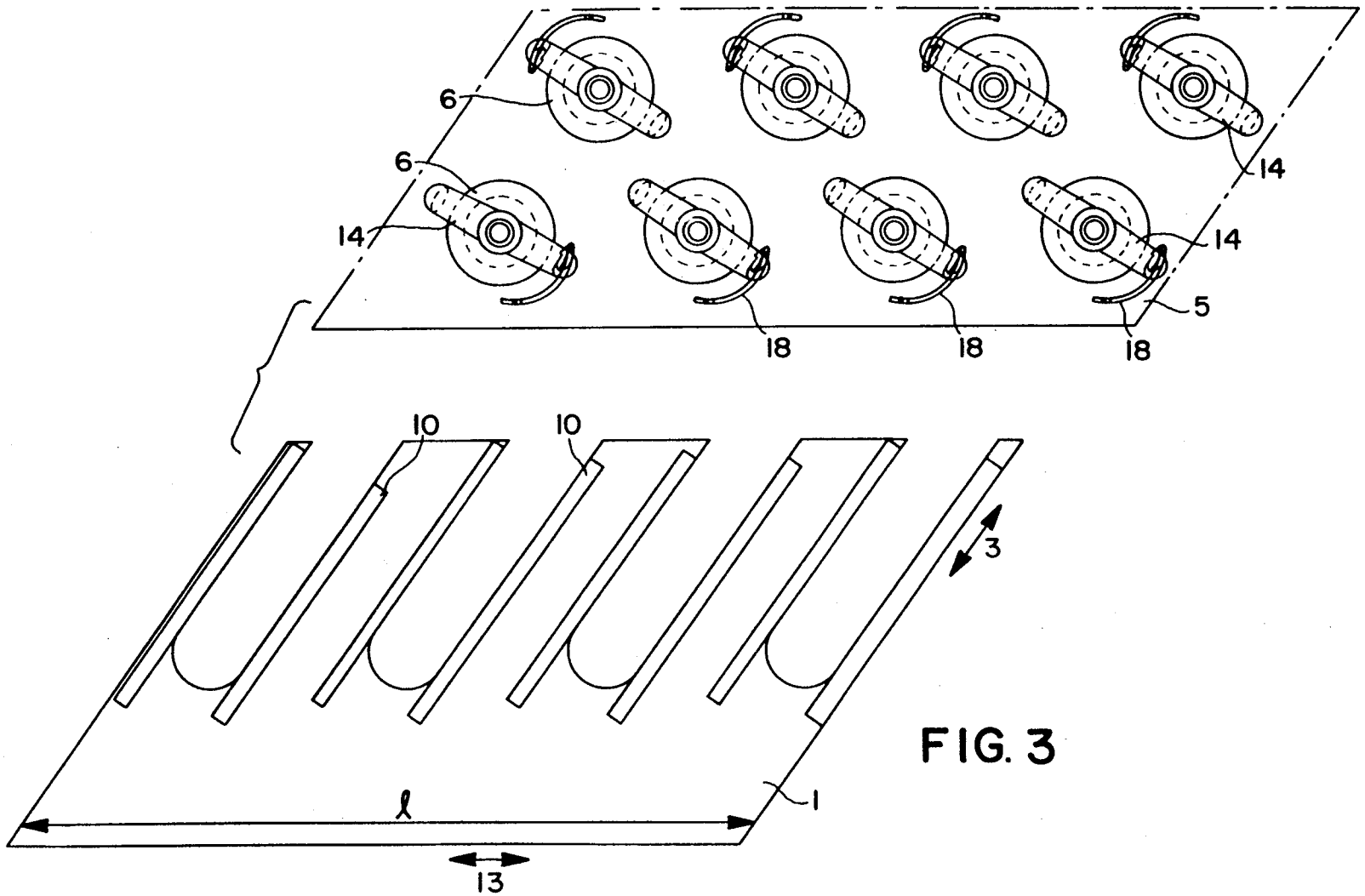
FIG. 3 is a plan view of the apparatus shown in FIG. 2, but in the following phase of the process according to the invention.

According to the invention, and as shown in FIGS. 1 to 3 of the accompanying drawings, the apparatus for automatic removal of bobbins is principally constituted, on the one hand, by a transporting fork 1, movable in a vertical direction 2 and in at least one horizontal direction 3 parallel to the transverse alignment of the spindles 4 of the spindle-carrying carriage 5, on the other hand, by cups 6 for supporting and manipulating the full bobbins 7 and the empty bobbins 8, and, finally, by a conveyor 9 for evacuation of the full bobbins 7 and for feeding the empty bobbins 8.

According to a first characteristic of the invention, shown particularly in FIGS. 1F, 1G, 2 and 3, the transporting fork 1 is provided with tongues 10 having springs 11 permitting grasping the edges 12 of the cups 6, during the manipulation of the full bobbins 7 or the empty bobbins 8 and thereby to avoid any displacement of said cups 6 relative to the fork 1.

The use of cups 6, threaded on the spindles 4 and supporting the empty bobbins 8 during winding, in combination with the transporting fork 1, increases the precision of the various manipulative stages, and facilitates particularly the centering operations. Moreover, during winding, it is possible to wind up the yarn over all the height of the bobbins 8, the fork 1 not contacting directly the full bobbins 7 and accordingly not requiring any free gripping zone on the bobbins 8.

According to a first modification of the invention, shown in FIGS. 2 and 3 of the accompanying designs, the width l of the transporting fork, 1 corresponds to a fraction of the length of the spindle-carrying carriage 5, said fork 1 being also movable in a direction 13 parallel to said spindle-carrying carriage 5. The automatic removal can be effected, for example, for groups of eight bobbins 8.

The process of automatic removal should thus be repeated as often as there are groups of eight spindles 4 on the spindle-carrying carriage 5. The passage from one group to the other will therefore be effected by displacement of the fork 1 in the direction 13.

According to a second modification of the invention, not shown in the accompanying drawings, the carrying fork 1, comprised as the case may be of several independent segments, extends over all the length of the spindle-carrying carriage 5. The control of this fork 1 can accordingly be either fractional, in the case of a construction of several segments, or general, in the case of a fork 1 of one piece. It is thus possible to effect the removal of all the bobbins 7 in a single operation; there thus results increased production thanks to shorter stoppage of operation of the bank of spindles.

According to another characteristic of the invention, not shown in the accompanying drawings, the automatic removal apparatus according to the invention comprises also a security device actuated during actuation of the transporting fork 1 and provided with audible and/or luminous signal means, said device permitting moreover as the case may be defining a safety zone about the bank of spindles in question.

The invention also has for its object a process for automatic removal of bobbins 7 employing the apparatus described above, which process consists, after the end of winding of the bobbins 7, breaking the yarn and the disengagement of the full bobbins 7 from their corresponding flyers 14, as the case may be by lowering the spindle-carrying carriage 5 (FIG. 1A), in extracting said full bobbins 7 from their corresponding spindles 4 (FIG. 1B) and transporting them toward an overhead conveyor 9 (FIG. 1D), by means of a carrying fork 1 coacting with cups 6 threaded on said spindles 4 and each supporting a bobbin 7, hooking said bobbins 7 to empty bobbin carriers 15 of said conveyor 9 (FIGS. 1E and 1F), the cups 6 remaining unitary with the fork 1, then uncoupling empty bobbins 8 in equal number from said conveyor 9 with the aid of said cups 6 (FIGS. 1G, 1H and 1I), carrying them toward the free spindles 4 of said spindle-carrying carriage 5, threading them together with cups 6 which support them on said spindles 4 (FIGS. 1J and 2) and, finally, disengaging said carrying fork 1 from said threaded cups 6 (FIG. 3) and bringing it into a disengaged rest position.

During the rising of the spindle-carrying carriage 5, a displacement of this latter beyond its normal position, during operation of the bank of spindles, will permit setting to the bottom the empty bobbins 8 on the spindles 4 thanks to abutments 17 disposed on flyers 14.

According to a further characteristic of the invention, and as shown particularly in FIGS. 1A and 1B of the accompanying drawings, the extraction of the full bobbins 7 from their spindles 4 consists first in feeding the fork 1, from its rest position, opposite the spindle-carrying carriage 5 and at the height of the cups 6, then introducing said fork 1 between the spindles 4 by a horizontal translation movement, so as to engage the cups 6 between the tongues 10 with springs 11 and the corresponding slideways 16 and, finally, unthreading the assemblies of cups 6 and bobbins 7 from their corresponding spindles 4 by vertical movement of said fork 1.

The displacement of the presser fingers 18 of the wings 14 to a spaced position during extraction of the bobbins 7 (FIGS. 1B and 1C), will finally permit the emplacement of the empty bobbins 8 (FIGS. 1J and 2) without risk of damaging said presser fingers 18.

This emplacement of the empty bobbins 8, toward the spindles 4, consists in effecting by means of the fork 1 reverse movements from those described above for extraction of the bobbins 7, in reverse order.

As shown in FIGS. 1D to 1I, the operations of hanging the full bobbins 7 and unhanging the empty bobbins 8 are effected by vertical movements of the fork 1, the arrangement of the bobbin carrier 15 on the overhead conveyor 9 corresponding to the arrangement of the spindles 4 on the spindle-carrying carriage 5. Moreover, between the phases shown in FIGS. 1F and 1G, the conveyor 9 moves by a length such that it presents opposite the empty cups an equal number of empty bobbins 8.

The actuation of the fork 1 can be effected for example by mechanical means controlled by electrical, hydraulic or pneumatic devices and controlled as the case may be by a programmable automation.

The tongues 10 could equally according to a modification be actuated by pneumatic or hydraulic means.

Thanks to the invention, it is accordingly possible to proceed with the automatic removal of the assembly or of all or a portion of the spindles 7 from a bank of bobbins 4 and replacing them by empty bobbins 8 by means of a fork 1 coacting with cups 6 for the support and manipulation of the bobbins 7 and the empty bobbins 8, permitting operation with high precision of movement and without direct handling of said bobbins 7 or the said empty bobbins 8.

Of course, the invention is not limited to the embodiments described and shown in the accompanying drawings. Modifications remain possible, particularly as to the construction of the various elements, or by substitution of technical equivalents, without thereby departing from the scope of protection of the invention.

I claim:

1. Apparatus for the automatic removal of bobbins from a bank of spindles, comprising a transporting fork (1) having a plurality of recesses for simultaneously handling a plurality of spindles, the transporting fork being movable in a vertical direction and in at least one horizontal direction parallel to a bank of spindles on a spindle carrying carriage, a cup through which each spindle is insertable for the support and manipulation of bobbins, a conveyor for the evacuation of full bobbins and for the supply of empty bobbins, and means on the transporting fork for releasably retaining a said cup in each said recess whereby each cup is seized by and disengaged from said fork upon movement of said fork in said at least one horizontal direction, the fork with cups in said recesses being upwardly movable to lift full bobbins from said spindles and to engage said full bobbins on said conveyor for removal, said fork then being downwardly movable to disengage the cups from the full bobbins and movable upwardly to engage the cups with empty bobbins on said conveyor and then movable downwardly to remove empty bobbins from the conveyor and to cause the spindles to be inserted through the cups and into the empty bobbins.

2. Apparatus according to claim 1, wherein the transporting fork (1) is provided with tongues (10) with springs (11) permitting grasping the edges (12) of the cups (6), during the manipulation of the full bobbins (7) or of the empty bobbins (8).

3. Apparatus according to claim 1 wherein the width (l) of the transporting fork (1) corresponds to a fraction of the length of the spindle-carrying carriage (5), said fork (1) being also movable in a direction (13) parallel to said bobbin-carrying carriage (5).

4. Apparatus according to claim 1, wherein the transporting fork (1) comprises several independent segments extending over all the length of the bobbin-carrying carriage (5).

5. Process for the automatic removal of bobbins on a bank of spindles comprising, after the end of winding of yarn on bobbins (7), breaking the yarn and disengaging the full bobbins (7) from flyers (14) by lowering a spindle-carrying carriage (5), extracting said full bobbins (7), from corresponding spindles (4) and transporting said full bobbins toward an overhead conveyor (9), by means of a transporting fork (1) coacting with cups (6) through which said spindles (4) extend upwardly, each said spindle initially supporting a full bobbin (7), attaching these full bobbins (7) to empty bobbin carries (15) of said conveyor (9), the cups (6) remaining in assembly with the fork (1), uncoupling and removing empty bobbins (8) of an equal number from said conveyor (9) by downward movement of said cups (6) carried by the fork (1), each said cup (6) then supporting an empty bobbin (8), transporting said empty bobbins toward free spindles (4) of said spindle-carrying carriage (5), inserting said empty bobbins together with said cups (6) which support them, on said free spindles (4) and, finally, disengaging said transporting fork (1) from said cups (6) and bringing said fork (1) to a disengaged rest position by horizontal movement of said fork relative to said cups (6).

6. Process according to claim 5, wherein the extraction of the full bobbins (7) from said spindles (4) consists first in introducing said fork (1) between the spindles (4) by a horizontal translatory movement, so as to engage the cups (6) between tongues (10) with springs (11) and corresponding slideways (16) and, finally, raising the assemblies of cups (6) and bobbins (7) from corresponding said spindles (4) by a vertical movement of said fork (1).

* * * * *